US007036468B2

(12) United States Patent
Kamiyama

(10) Patent No.: US 7,036,468 B2
(45) Date of Patent: May 2, 2006

(54) INTERNAL COMBUSTION ENGINE WITH VARIABLE COMPRESSION RATIO AND COMPRESSION RATIO CONTROL METHOD

(75) Inventor: Eiichi Kamiyama, Mishima (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 10/816,889

(22) Filed: Apr. 5, 2004

(65) Prior Publication Data

US 2004/0211374 A1 Oct. 28, 2004

(30) Foreign Application Priority Data

Apr. 22, 2003 (JP) ..... 2003-117297

(51) Int. Cl.
*F02B 75/04* (2006.01)

(52) U.S. Cl. ..... 123/78 R

(58) Field of Classification Search ..... 123/48 R, 123/48 C, 78 R, 78 C, 78 F
See application file for complete search history.

(56) References Cited

U.S. PATENT DOCUMENTS 6,550,441 B1 * 4/2003 Drangel et al. ..... 123/195 R

FOREIGN PATENT DOCUMENTS

DE 24 04 231 A 7/1975
JP A 7-26981 1/1995
JP A 2003-206771 7/2003
WO WO 00/55483 A1 9/2000
WO WO 02/103174 A1 12/2002

OTHER PUBLICATIONS

Haraldsson et al. "HCCI Combustion Phasing in a Multi Cylinder Engine Using Variable Compression Ratio," 2002-01-2858, Society of Automotive Engineers, Inc., 2002.
Schwaderlapp et al. "Variable Compression Ratio—A Design for Fuel Economy Concepts," 2002-01-1103, Society of Automotive Engineers, Inc., 2002.
Moteki et al. "A Study of Variable Compression Ratio System With a Multi-Link Mechansim," Society of Automotive Engineers International, 2003.

* cited by examiner

*Primary Examiner*—Henry C. Yuen
*Assistant Examiner*—Hyder Ali
(74) *Attorney, Agent, or Firm*—Oliff & Berridge, PLC

(57) ABSTRACT

A variable compression ratio engine has a compression ratio varying mechanism, which moves a cylinder block relative to a lower case. The rotational driving force of a servo motor is transmitted to vertical sliding movements of the cylinder block by means of cam shafts with eccentric cams. First and second rows of spring members and are arranged on both sides of the cylinder block. The resultant spring force of the first and second spring members is applied to the cylinder block and the lower case. The resultant spring force works to reduce the transmission torque of the rotational driving force of the servo motor and assist the compression ratio varying mechanism to vary a compression ratio of the engine. The technique simplifies the control procedure of varying the compression ratio of the engine and reduces the size of the mechanism required.

3 Claims, 12 Drawing Sheets

INTERNAL COMBUSTION ENGINE WITH VARIABLE COMPRESSION RATIO AND COMPRESSION RATIO CONTROL METHOD

BACKGROUND OF THE INVENTION

1. Field of the Invention

The present invention relates to an internal combustion engine with a variable compression ratio, as well as to a corresponding compression ratio control method.

2. Description of the Related Art

Diverse internal combustion engines with a function of variable compression ratio have been proposed recently. The high setting of the compression ratio ensures efficient power generation but tends to cause knocking. The compression ratio is thus varied according to the driving conditions. While the internal combustion engine has a low load, the potential for the knocking is low and the compression ratio is set to a large value. While the internal combustion engine has a high load, on the other hand, the potential for the knocking is high and the compression ratio is set to a small value.

A proposed compression ratio varying mechanism makes a crank casing for supporting a crankshaft and a cylinder block of a piston head apart from each other and close to each other to vary the compression ratio (for example, see Patent Document 1).

Patent Document 1: Japanese Patent Laid-Open Gazette No. 7-26981

In this cited Patent Document 1, an eccentric cam shaft is interposed between the two mechanical members, that is, the crank casing and the cylinder block, and a worm and a worm wheel are used to transmit the power to the eccentric cam shaft. The worm is linked with a driving source, such as a motor, whereas the worm wheel is linked with the object of actuation (that is, the eccentric cam shaft). Rotations of the motor in a normal direction and in an inverse direction rotate the eccentric cam shaft to make the two mechanical members apart from each other and close to each other.

In this prior art variable compression ratio engine, combustion pressure generated in a combustion chamber works to make the relative position of the piston to the cylinder, that is, the relative position of the crank casing to the cylinder block, apart from each other. The force due to the combustion pressure (hereafter referred to as the force of the combustion pressure) accordingly works to supplement the driving force required by the compression ratio varying mechanism in the case of decreasing the compression ratio. In the case of increasing the compression ratio, on the other hand, the force of the combustion pressure works to interfere with actuation of the compression ratio varying mechanism. In this case, it is required to actuate the compression ratio varying mechanism against the combustion pressure. Transmission of a large driving force to the compression ratio varying mechanism is essential in this case. Namely the driving force to be transmitted to the compression ratio varying mechanism in the case of decreasing the compression ratio is different from the required driving force in the case of increasing the compression ratio. The driving source is thus required to have high power performance, which ensures generation of a maximum required driving force in the course of a variation in compression ratio.

In the course of decreasing the compression ratio, the engine has a high load. A slow decrease of the compression ratio thus heightens the potential for knocking. A quick decrease of the compression ratio is required to prevent the occurrence of knocking. The driving source is accordingly required to have a high response and rotating characteristics in a wide range of revolution speed, in addition to the extremely high power performance. This undesirably increases the size of the driving source and thereby the size of the whole engine including the compression ratio varying mechanism, while making control of the driving source rather complicated.

In the mechanism of changing the positional relation between the mechanical members with rotation of the eccentric cam shaft to vary the compression ratio, the compression ratio depends upon the engagement of the eccentric cams with their mating elements, that is, the rotational position of the eccentric cam shaft. The force of the combustion pressure acts on the eccentric cam shaft to assist or interfere with the driving force of the driving source. The rotational position of the eccentric cam shaft affects application of the force due to the combustion pressure onto the eccentric cam shaft (that is, the magnitude of the force to rotate the eccentric cam shaft).

In the course of varying the compression ratio, there are a frictional force due to the rotation of the eccentric cam shaft and a frictional force due to the positional change of the mechanical members. These frictional forces act to interfere with transmission of the driving force from the driving source. Even when the force of the combustion pressure works to supplement the driving force of the driving source in the case of decreasing the compression ratio, the frictional forces may reduce or even totally cancel the supplementary action in a range of low compression ratio. The driving force is thus required to have the performance to allow a decrease in compression ratio without any supplementary force of the combustion pressure. This undesirably increases the size of the driving source.

SUMMARY OF THE INVENTION

The object of the invention is thus to eliminate the drawbacks of the prior art structures and to simplify a control procedure of varying the compression ratio of an engine and reduce the size of a mechanism for this purpose.

In order to attain at least part of the above and the other related objects, the present invention is directed to an internal combustion engine with a variable compression ratio and a corresponding compression ratio control method. In this internal combustion engine and the compression ratio control method of the invention, the rotational driving force of a driving source, which is used to vary a compression ratio, is transmitted to a compression ratio varying mechanism by a transmission module. The compression ratio varying mechanism drives at least one of a mechanical member of a piston head and a mechanical member of a crank casing to change a positional relation between the two mechanical members. The change of the positional relation varies the volume of a combustion chamber and thereby varies the compression ratio. In the course of changing the positional relation of the two mechanical members to vary the compression ratio, a pressing module produces a pressing force according to the positional relation between the two mechanical members and applies the pressing force to the two mechanical members.

The pressing module applies the pressing force to the two mechanical members to reduce the transmission torque of the rotational driving force of the driving source by the transmission module and thereby assist the variation in compression ratio by the compression ratio varying mechanism. This arrangement does not require the driving source to have an extremely large rotational driving force for actuation of the compression ratio varying mechanism. The driving source is thus not required to have extremely high power performance. This desirably reduces the size of the driving source and thereby the size of the whole internal combustion engine including the compression ratio varying mechanism. No special control of the driving source is required for production and application of the pressing force. This arrangement also simplifies the control of the driving source.

As described above, while the compression ratio varying mechanism is actuated to change the positional relation between the two mechanical members and vary the compression ratio, a force due to combustion pressure (a first force) is involved in transmission of the driving force to the compression ratio varying mechanism by the transmission module. The state of involvement depends upon the varying direction of the compression ratio. In the case of decreasing the compression ratio, the first force acts to reduce the transmission torque by the transmission module. In the case of increasing the compression ratio, on the other hand, the first force acts to enhance the transmission torque. Actuation of the compression ratio varying mechanism causes a physical movement of at least the two mechanical members. The physical movement causes a frictional force (a second force), which enhances the transmission torque, regardless of the varying direction of the compression ratio.

One preferable embodiment of the invention focuses attention on the relationship of these forces and applies the pressing force to the two mechanical members, such that the pressing force is combined with a first force, which is produced by a combustion pressure to be involved in the transmission of the rotational driving force to the compression ratio varying mechanism by the transmission module, and with a second force, which is produced by actuation of the compression ratio varying mechanism to be involved in the transmission of the rotational driving force, to reduce the transmission torque.

Even when the first force is varied with a variation in compression ratio, the pressing force produced by the pressing module is adequately regulated to relieve the variation in resultant force of the first force, the second force, and the pressing force. For example, when the first force acting to reduce the transmission torque by the transmission module is decreased with a variation in compression ratio or by the relation to the second force, the pressing force may be regulated to supplement the decrease. In another example, when the first force acts to enhance the transmission torque, the pressing force may be regulated to relieve the enhancement. This arrangement does not require the driving source to have extremely high power performance or any special control, thus desirably reducing the size of the compression ratio varying mechanism and simplifying the control procedure. This is especially effective when the first force acts to reduce the transmission torque by the transmission module, that is, in the case of decreasing the compression ratio. In this case, the pressing force supplements the decrease of the first force. The rotational driving force of the driving source is thus quickly and effectively transmitted to the compression ratio varying mechanism by the transmission module. This ensures a quick decrease in compression ratio.

The pressing module may have a spring mechanism that has a spring characteristic regulated to supplement the first force in an actuation state of the compression ratio varying mechanism to decrease the compression ratio. The pressing force may have a spring mechanism that has a spring characteristic regulated to relieve the first force in an actuation state of the compression ratio varying mechanism to increase the compression ratio. In either of these structures, the spring mechanism is simply interposed between the two mechanical members. The variation in the first force is related to the variation in compression ratio by actuation of the compression ratio varying mechanism by some experimental or empirical technique or by computer-based analysis. The spring mechanism having the above spring characteristic is thus readily obtained.

These and other objects, features, aspects, and advantages of the present invention will become more apparent from the following detailed description of the preferred embodiments with the accompanying drawings.

DETAILED DESCRIPTION OF THE PREFERRED EMBODIMENTS

Figure 1:
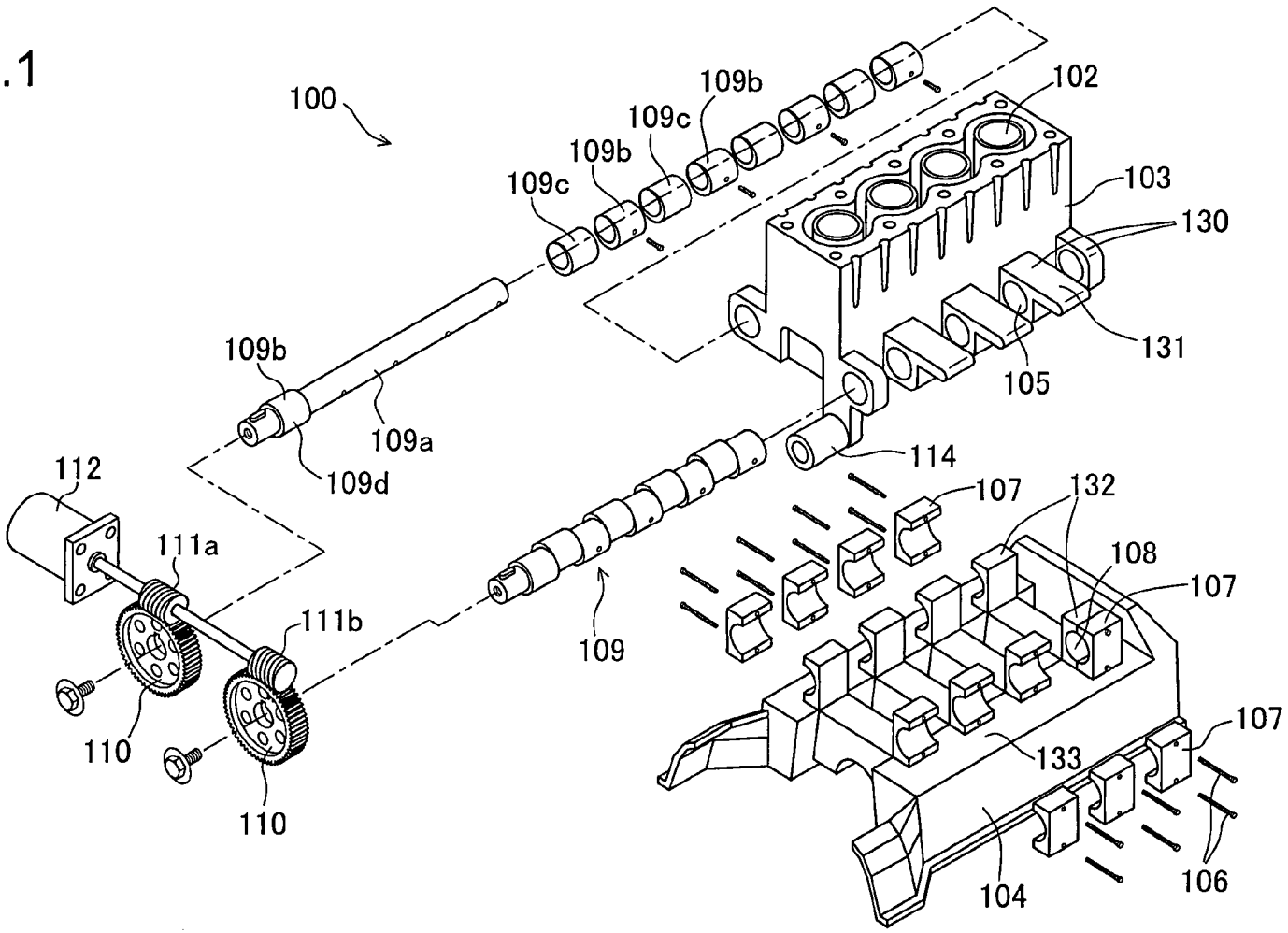
FIG. 1 is a decomposed perspective view schematically illustrating a variable compression ratio engine 100 in a first embodiment of the invention.
Figure 2:
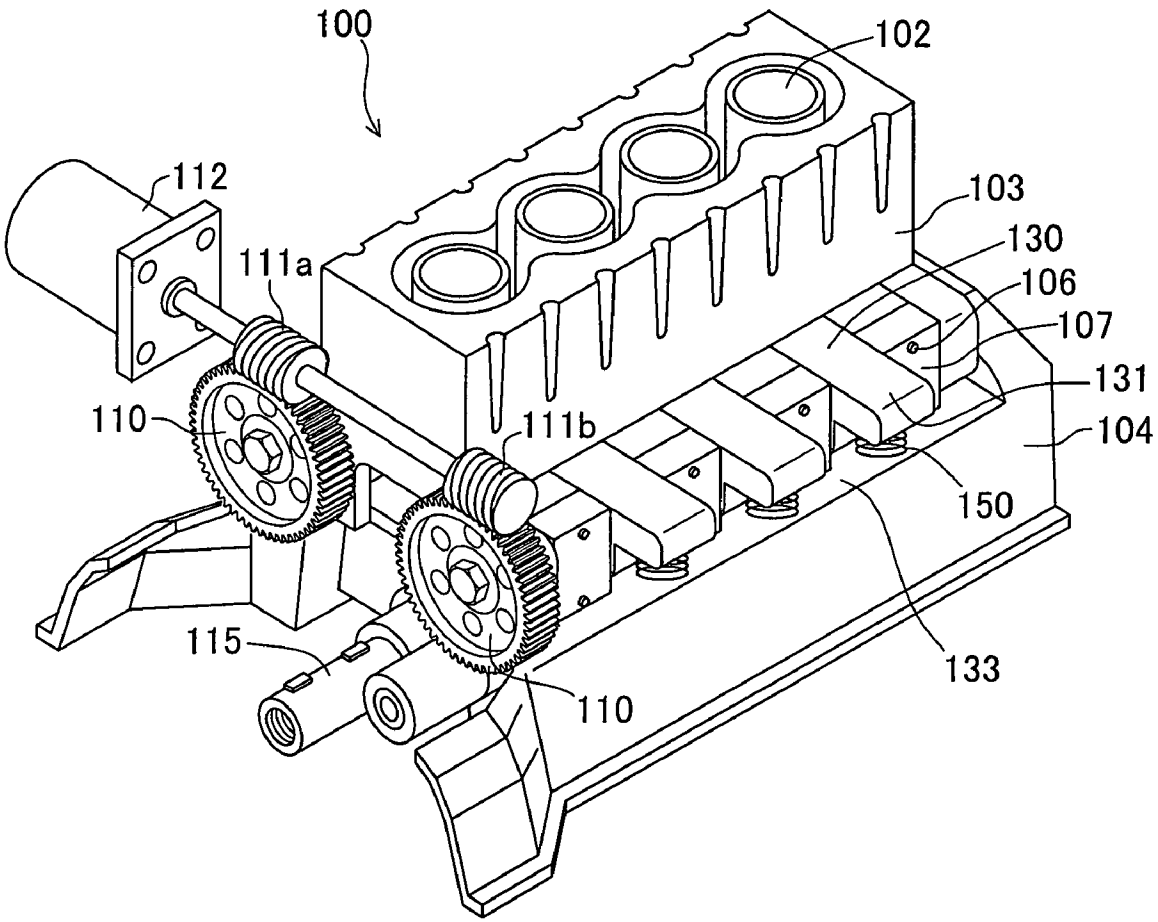
FIG. 2 is a perspective view schematically illustrating the structure of the variable compression ratio engine 100.
Figure 3:
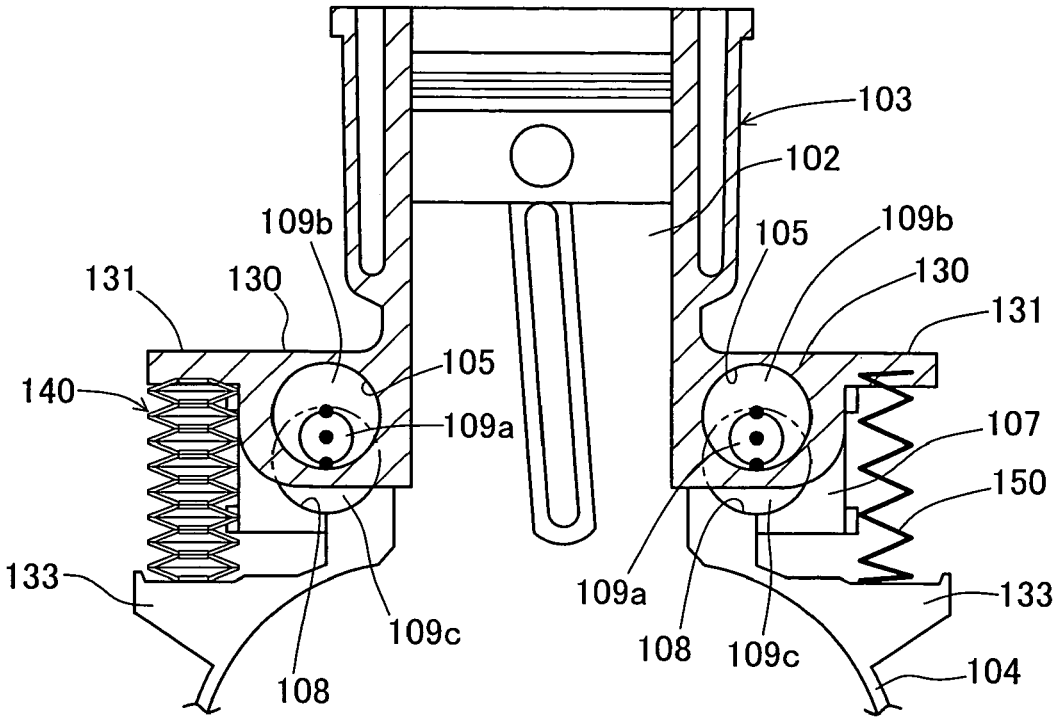
FIG. 3 is a sectional view showing a main part of the variable compression ratio engine 100.

Some modes of carrying out the invention are discussed below as preferred embodiments. FIG. 1 is a decomposed perspective view schematically illustrating a variable compression ratio engine 100 in a first embodiment of the invention. FIG. 2 is a perspective view schematically illustrating the structure of the variable compression ratio engine 100. FIG. 3 is a sectional view showing a main part of the variable compression ratio engine 100.

In the variable compression ratio engine 100 of the first embodiment, a cylinder block 103 is moved in an axial direction of cylinders 102 relative to a lower case (crank case) 104 to change the volume of a combustion chamber and thereby vary the compression ratio. The variable compression ratio engine 100 of the embodiment accordingly has a compression ratio varying mechanism to move the cylinder block 103 relative to the lower case 104. The compression ratio varying mechanism will be discussed later in detail.

As the cylinder block 103 is moved in the axial direction of the cylinders 102 relative to the lower case 104, a cam shaft (not shown) functioning to open and close intake/exhaust valves located on an upper portion of the cylinders 102 moves relative to the lower case 104. The rotational driving force of the cam shaft is transmitted from a crankshaft 115 located in the lower case 104 via a chain and a belt. The variable compression ratio engine 100 of this embodiment has a mechanism for transmission of this rotational driving force. This mechanism is, however, not characteristic of the invention and is not specifically described here.

The structure of the variable compression ratio engine 100 of this embodiment is similar to the structure of the general engine, except the movable cylinder block 103 relative to the lower case 104, its moving mechanism (compression ratio varying mechanism), and transmission of fluctuating force to the cam shaft. The conventional structure is not characteristic of the invention and is not specifically described here.

Referring to FIG. 1, the variable compression ratio engine 100 has multiple flange elements 130 projected from both lower sides of the cylinder block 103. Each of the flange elements 130 has a cam hole 105. Each side of the cylinder block 103 has five cam holes 105 in this embodiment. The cam holes 105 are substantially circular in shape and are aligned perpendicular to the axial direction of the cylinders 102 and in parallel with the aligning direction of the multiple cylinders 102 (where the variable compression ratio engine 100 of this embodiment is a four-cylinder engine). The multiple cam holes 105 on each side of the cylinder block 103 are aligned on one identical axis line. The two axis lines of the cam holes 105 on both sides of the cylinder block 103 are parallel to each other.

Each of non-end flange elements 130 (three in this embodiment) among the multiple flange elements 130 (five in this embodiment) has a greater wall thickness at the position of forming the cam hole 105 and has an upper end protrusion 131 projected horizontally from its upper end. The upper end protrusions 131 are arranged to face a spring mounted portion 133 formed on the lower case 104 and function to fix spring members (not shown) on their upper ends.

The lower case 104 has multiple upright wall elements 132, which are designed to be located between the multiple flange elements 130 with the cam holes 105. Each of the upright wall elements 132 has a semicircular recess formed on its outer surface, which faces each side of the lower case 104. A cap 107 is fastened to each upright wall element 132 by means of bolts 106. The cap 107 also has a semicircular recess. Combination of each upright wall element 132 with the cap 107 defines a circular bearing hole 108. The shape of the bearing hole 108 is identical with the shape of the cam hole 105.

Each side of the lower case 104 has four bearing holes 108 in this embodiment. Like the cam holes 105, the multiple bearing holes 108 are aligned perpendicular to the axial direction of the cylinders 102 and in parallel with the aligning direction of the multiple cylinders 102, when the cylinder block 103 is attached to the lower case 104. After assembly of the cylinder block 103 and the lower case 104, the multiple bearing holes 108 are aligned on one identical axis line on each side of the cylinder block 103. The two axis lines of the bearing holes 108 on both sides of the cylinder block 103 are parallel to each other. The distance between the two axis lines of the cam holes 105 is identical with the distance between the two axis lines of the bearing holes 108.

The multiple cam holes 105 and the multiple bearing holes 108 are arranged alternately to form one row of continuous holes on each side of the cylinder block 103. A camshaft 109 is inserted through each row of continuous holes. The camshaft 109 has cams 109*b* and movable bearings 109*c* set on a shank 109*a*, as shown in FIG. 1. The cams 109*b* are fixed to the shank 109*a* in an eccentric manner from the center axis of the shank 109*a* and have circular cam profiles. The movable bearings 109*c* have an identical contour with that of the cams 109*b* and are set on the shank 109*a* in a movable manner. In the structure of this embodiment, the cams 109*b* and the movable bearings 109*c* are arranged alternately. The two cam shafts 109 mutually form mirror images across the cylinder 102. One end of each cam shaft 109 forms a joint element 109*d* with a worm wheel 110 (discussed later). The center of the joint element 109*d* is eccentric from the center axis of the shank 109*a* but is concentric with the center of the cams 109*b*.

The movable bearings 109*c* are also eccentric from the shank 109*a*. The eccentricity of the movable bearings 109*c* is identical with the eccentricity of the cams 109*b*. The actual manufacturing process first produces the cam shaft 109 integrated with one cam 109*b* on the end-most position, and then sets the movable bearings 109*c* and the other cams 109*b* alternately on the cam shaft 109. Only the cams 109*b* are fixed to the shank 109*a* by means of screws as illustrated. The cams 109*b* may be fixed by any other suitable means, for example, by press fitting or by welding. The number of the cams 109*b* fixed to the shank 109*a* is identical with the number of the cam holes 105 formed on each side of the cylinder block 103. The thickness of each cam 109*b* is identical with the length of each corresponding cam hole 105. Similarly the number of the movable bearings 109*c* set on the shank 109*a* is identical with the number of bearing holes 109 formed on each side of the lower case 104. The thickness of each movable bearing 109*c* is identical with the length of each corresponding bearing hole 108.

The multiple cams 109*b* set on each cam shaft 109 are eccentric in an identical direction. The movable bearings 109*c* have an identical circular shape with that of the cams 109*b*. Rotation of the movable bearings 109*c* causes the outer surface of the multiple cams 109*b* to be continuous with the outer surface of the multiple movable bearings 109*c*. In this state, the cylinder block 103 is attached to the lower case 104, while the cam shaft 109 is inserted through each row of continuous holes including the multiple cam holes 105 and the multiple bearing holes 108. The caps 107 may be attached to the upright wall elements 132 on the lower case 104, after positioning of the cam shaft 109 relative to the cylinder block 103 and the lower case 104.

The cam holes 105, the bearing holes 108, the cams 109*b*, and the movable bearings 109*c* have all an identical circular shape. The cylinder block 103 is slidable to the lower case 104. Specific elements like piston rings are set on the sliding faces of both the cylinder block 103 and the lower case 104 to keep airtightness between the inner face of the cylinders and pistons. Rubber gaskets like O rings or any other suitable means may be applied for sealing.

Each cam shaft 109 has the worm wheel 110 set on the joint element 109*d* on the end of the shank 109*a*. The worm wheel 110 is positioned by a key and is bolted to the joint element 109*d*.

Worms 111*a* and 111*b* respectively engage with the worm wheels 110, 110 set on the pair of cam shafts 109. The worms 111*a* and 111*b* are linked with an output shaft of a single servo motor 112, which is rotatable in both normal and inverse directions. The worms 111*a* and 111*b* have spiral grooves, which rotate in mutually inverse directions. The worm wheels 110 are rotated by actuation of the servo motor 112 to rotate the pair of cam shafts 109 in mutually inverse directions. The servo motor 112 is fixed to the cylinder block 103 and is integrally movable with the cylinder block 103.

As shown in FIG. 3, the variable compression ratio engine 100 having the pair of eccentric cam shafts 109 interposed between the cylinder block 103 and the lower case 104 has first spring members 140 and second spring members 150 spanned between the upper end protrusions 131 of the cylinder block 103 and the spring mounted portion 133 of the lower case 104. These spring members 140 and 150 are arranged corresponding to the flange elements 130 with the upper end protrusions 131 on both sides of the cylinder block 103. Each of these spring members 140 and 150 has an upper end fixed to the upper end protrusion 131 and a lower end fixed to the spring mounted portion 133. The spring forces of the first spring members 140 and the second spring members 150 are accordingly applied to the cylinder block 103 and the lower case 104.

Each of the first spring members 140 is constructed by a set of disc springs laid one upon another alternately in inverse directions and has S-characteristics. The structure of this embodiment uses the first spring members 140 in a specific range of the S-characteristics, where the greater displacement gives the smaller spring load. The first spring members 140 apply their spring load (spring force) onto the cylinder block 103 and the lower case 104 in a direction of making the cylinder block 103 apart from the lower case 104. In the state of FIG. 3, the compression ratio is set at a lower limit. The first spring members 140, which are set in a slightly compressed state, produce the spring load (spring force) corresponding to the compression in the direction of making the cylinder block 103 apart from the lower case 104 and apply the spring force onto the cylinder block 103 and the lower case 104. When the cylinder block 103 and the lower case 104 are made close to each other to heighten the compression ratio from the illustrated state, the interval between the upper end protrusions 131 and the spring mounted portion 133 is narrowed to increase the compression displacement of the first spring members 140. The greater compression displacement decreases the spring load of the first spring members 140. The first spring members 140 then reduce the spring force acting in the direction of making the cylinder block 103 apart from the lower case 104 and apply the reduced spring force onto the cylinder block 103 and the lower case 104.

Each of the second spring members 150 is a coil spring and exerts the greater spring load (spring force) with an increase in displacement. In the state of FIG. 3, the second spring members 150 are set with a large tensile displacement. In the illustrated state, the second spring members 150 produce a large spring load (spring force) in a direction of making the cylinder block 103 close to the lower case 104 and apply this large spring force onto the cylinder block 103 and the lower case 104. An increase in compression ratio from this illustrated state decreases the tensile displacement of the second spring member 150 and thereby reduces the spring load of the second spring member 150. The second spring members 150 then reduce the spring force acting in the direction of making the cylinder block 103 close to the lower case 104 and apply the reduced spring force onto the cylinder block 103 and the lower case 104.

As discussed above, the first spring members 140 and the second spring members 150 apply the respective spring loads onto the cylinder block 103 and the lower case 104. A resultant force of the spring force of the first spring members 140 and the spring force of the second spring members 150 (that is, a resultant spring force) is accordingly applied to both the cylinder block 103 and the lower case 104.

The compression ratio depends upon the interval between the cylinder block 103 and the lower case 104 (that is, the interval between the upper end protrusions 131 and the spring mounted portion 133). This interval corresponds to the displacement of the spring members 140 and 150. The discussion now regards the variations in spring forces of the first spring members 140 and the second spring members 150 against a variation in compression ratio, with reference to the graph of FIG. 4.

Figure 4:
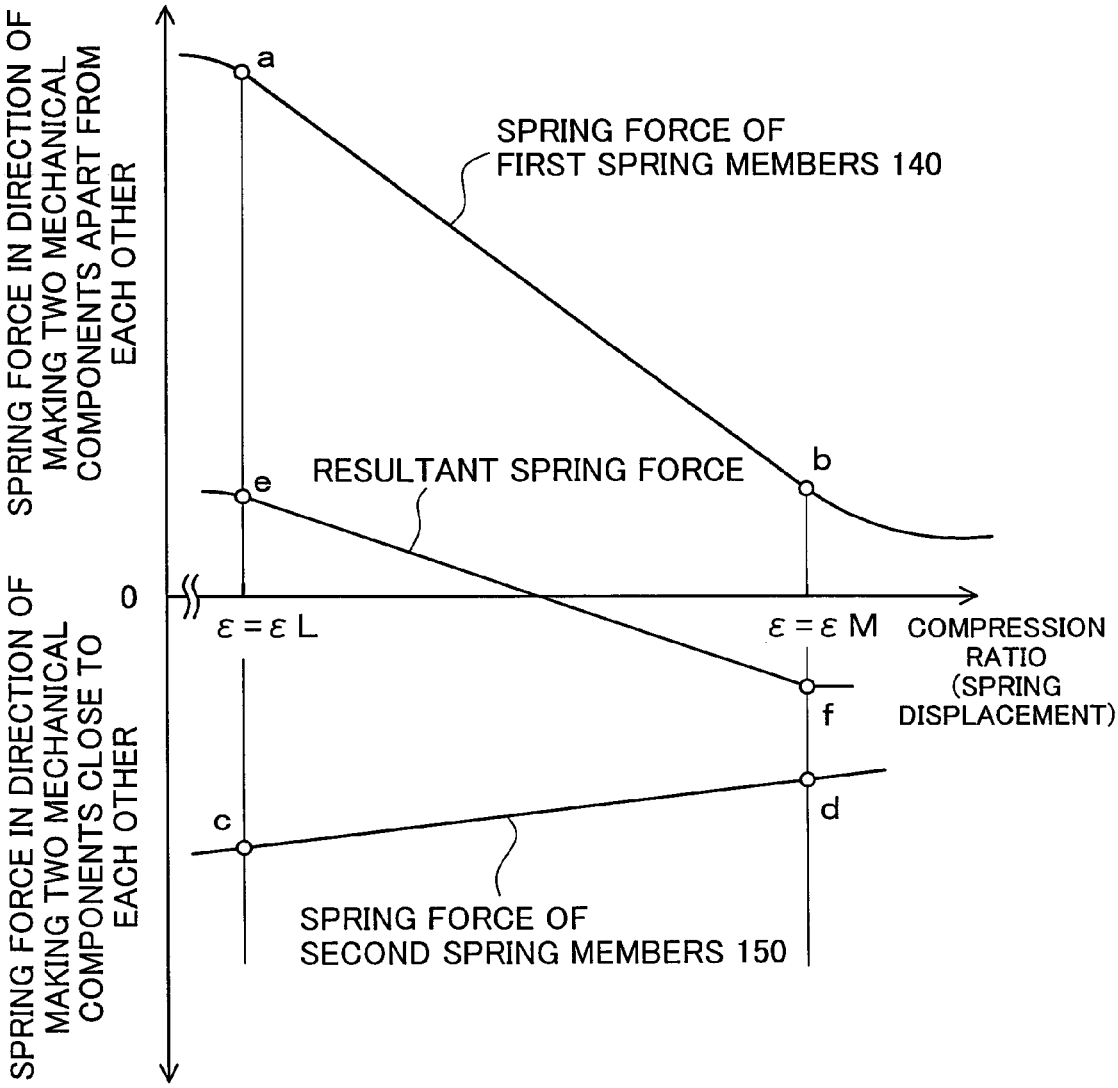
FIG. 4 shows variations of spring forces of first spring members and second spring members against a variation in compression ratio.

In the graph of FIG. 4, a variation in compression ratio $\epsilon$ and in spring displacement is plotted as abscissa, and variations in spring forces of the first spring members 140 and the second spring members 150 applied onto the cylinder block 103 and the lower case 104 (hereafter may be referred to as two mechanical components) are plotted as ordinate. The spring force of making the two mechanical components apart from each other is shown in the upper quadrant, whereas the spring force of making the two mechanical components close to each other is shown in the lower quadrant.

The variable compression ratio engine 100 of this embodiment has a variable range of compression ratio from a lower limit compression ratio $\epsilon L$ to an upper limit compression ratio $\epsilon M$ on the abscissa. The first spring members 140 exert the spring force characteristics defined by a characteristic curve, which connects a point 'a' at the lower limit compression ratio $\epsilon L$ (this corresponds to the state of FIG. 3) with a point 'b' at the upper limit compression ratio $\epsilon M$. The first spring members 140 accordingly apply the spring force corresponding to the compression ratio (spring displacement) in the direction of making the two mechanical components apart from each other as described above. The second spring members 150 exert the spring force characteristics defined by a characteristic curve, which connects a point 'c' with a point 'd', and apply the spring force corresponding to the compression ratio (spring displacement) in the direction of making the two mechanical components close to each other as described above. The respective spring members have individually different spring force characteristics. Each of the first spring members 140 has spring force characteristics, which correspond to the total of S-characteristics of the respective disc springs included therein. The variation in spring force (the gradient) of the first spring member 140 depends upon the design of the respective disc springs. Each of the second spring members 150 has spring force characteristics, which correspond to the spring constant of the coil spring. The variation in spring force (the gradient) of the second spring member 150 depends upon the setting of the spring constant.

In the structure of the first embodiment, the first spring members 140 have the spring force significantly reduced with an increase in compression ratio (that is, an increase in spring displacement) and apply the spring force (the point 'b') in the direction of making the two mechanical components apart from each other even at the upper limit compression ratio εM. The second spring members 150, on the other hand, apply the smaller spring force (the point 'c') than the spring force of the first spring members 140 in the direction of making the two mechanical components close to each other at the lower limit compression ratio εL. The second spring members 150 have the small setting of the spring constant to lessen the reduction of the spring force and apply the spring force (the point 'd') in the direction of making the two mechanical components close to each other even at the upper limit compression ratio εM. A resultant spring force defined by a characteristic curve connecting a point 'e' with a point 'f' with a variation in compression ratio is accordingly applied onto the cylinder block 103 and the lower case 104. The resultant spring force first works in the direction of making the two mechanical components apart from each other in the vicinity of the low limit compression ratio εL, gradually changes its working direction with an increase in compression ratio, and works in the direction of making the two mechanical components close to each other in the vicinity of the upper limit compression ratio εM. Since the respective first and the second spring members 140 and 150 have variable spring force characteristics, the resultant spring force is also variable.

Figure 5:
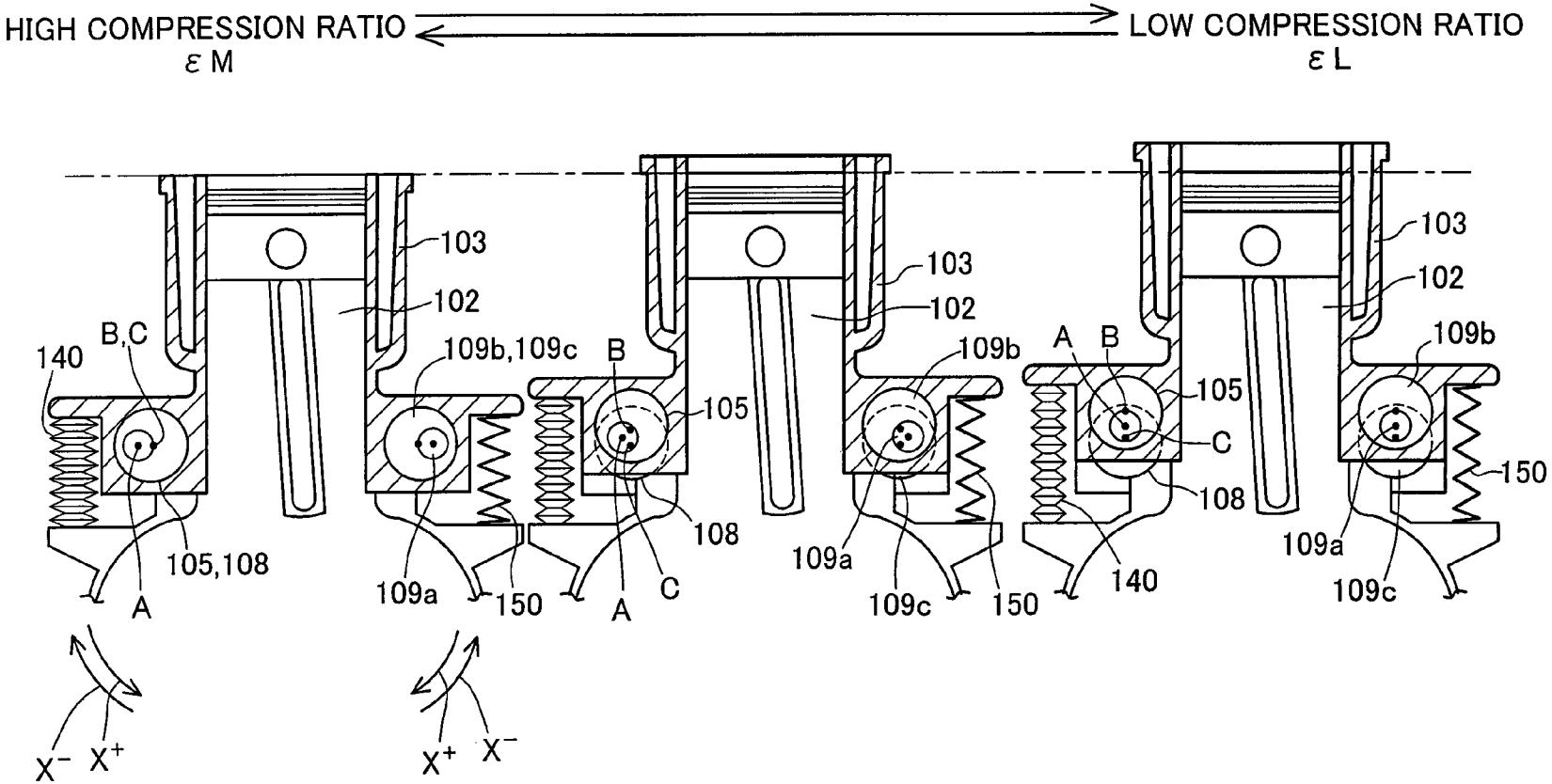
FIG. 5 shows the movement of a mechanism for varying the compression ratio in the variable compression ratio engine 100 of the first embodiment.

The discussion now regards a variation in compression ratio in the variable compression ratio engine 100 of the embodiment. FIG. 5 shows the movement of the mechanism for varying the compression ratio in the variable compression ratio engine 100. FIGS. 5(*a*) through 5(*c*) are sectional views of the compression ratio varying mechanism including the cylinder block 103, the lower case 104, and the cam shafts 109 interposed therebetween. In these drawings, symbols A, B, and C respectively denote the center of the shank 109*a*, the center of the cams 109*b*, and the center of the movable bearings 109*c*.

In the state of FIG. 5(*a*), all the outer circumferences of the cams 109*b* and the movable bearings 109*c* form a continuous surface, seen from the extension of the shank 109*a*. The shanks 109*a* of the left and the right cam shafts 109 are respectively located on the outer side from the center in the corresponding continuous holes of the cam holes 105 and the bearing holes 108. The angle of the cam shaft 109 is 0 degree in this positional state.

Each shank 109*a* (with the cams 109*b* fixed to the shank 109*a*) is rotated in a direction of an arrow X+ from the state of FIG. 5(*a*) to the state of FIG. 5(*b*). Here the two cam shafts 109 are rotated in inverse directions, which are the corresponding directions of the arrows X+. In this state, the eccentric direction of the movable bearings 109*c* relative to the shank 109*a* is deviated from the eccentric direction of the cams 109*b* relative to the shank 109*a*. The cylinder block 103 is accordingly slidable relative to the lower case 104 in the direction of a top dead center. The slidable amount is maximized when the shanks 109*a* of the respective cam shafts 109 are rotated in the corresponding directions of the arrows X+ to the state of FIG. 5(*c*). The slidable amount is double the eccentricities of the cams 109*b* and the movable bearings 109*c*. The cams 109*b* and the movable bearings 109*c* respectively rotate in the cam holes 105 and the bearing holes 108 to allow the movement of the shank 109*a* in the cam holes 105 and the bearing holes 108.

In the state of FIG. 5(*a*), the interval between the cylinder block 103 and the lower case 104 or the piston top dead center is relatively short to have the reduced volume of the combustion chamber and set the high compression ratio. In the state of FIG. 5(*c*), on the other hand, the interval between the cylinder block 103 and the piston top dead center is expanded to increase the volume of the combustion chamber and set the low compression ratio. Namely the movement of the cylinder block 103 from the state of FIG. 5(*a*) to the state of FIG. 5(*c*) decreases the compression ratio.

The cam shaft 109 is rotated in the direction of the arrow X+ to decrease the compression ratio, while the servo motor 112 rotates in the normal direction. The angle of the cam shaft 109 is +90 degrees in the positional state of FIG. 5(*c*).

The cylinder block 103 receives the upward driving force of the servo motor 112 via the cam shaft 109 and lifts up to be apart from the lower case 104. The force due to the combustion pressure (hereafter referred to as the force of the combustion pressure) generated in the combustion chamber works to move up the cylinder block 103 relative to the lower case 104. While the compression ratio decreases, the combustion pressure thus works in the same direction as the rotational driving force applied to the cylinder block 103. The rotations of the cam shafts 109 and the slide of the cylinder block 103 cause some frictional force. The frictional force works to interfere with the movement of the cylinder block 103, that is, transmission of the rotational driving force of the servo motor 112 via the cam shafts 109. With such a decrease in compression ratio, the first spring members 140 and the second spring members 150 apply the resultant spring force shown in FIG. 4 onto the cylinder block 103 and the lower case 104. The cylinder block 103 and the lower case 104 receive these various forces with the variation in compression ratio, as described later.

In the state of FIG. 5(*a*) where the outer circumferences of the cams 109*b* and the outer circumferences of the movable bearings 109*c* form a continuous surface, the multiple movable bearings 109*c* set on one cam shaft 109 may interfere with the vertical movement of the cylinders and cause a slippage. The compression ratio varying mechanism of this embodiment accordingly avoids the state of FIG. 5(*a*) where the outer circumferences of the cams 109*b* and the outer circumferences of the movable bearings 109*c* form a continuous surface. In the state of FIG. 5(*a*), the rotational positions of the cam shafts 109 are at the reference point, 0 degree. In the state of FIG. 5(*c*), the rotational positions of the cam shafts 109 are at 90 degrees in the corresponding directions of the arrows X+. The compression ratio varying mechanism of this embodiment does not use the rotational position close to 0 degree (for example, an angle range of 0 to 5 degrees) and rotates the cam shafts 109 in a range of 5 degrees to 90 degrees to prevent the potential slippage problem. The actual sliding amount of the cylinder block 103 is several millimeters, so that omission of the angle range of 0±5 degrees (180±5 degrees) causes no significant trouble.

The servo motor 112 is rotated in the inverse direction to return the slide of the cylinder block 103 from the state of FIG. 5(*c*) to the state of FIG. 5(*a*) and heighten the compression ratio. The shanks 109*a* of the cam shafts 109 with the cams 109*b* and the movable bearings 109*c* are accordingly rotated in the respective inverse directions, that is, in the corresponding directions of arrows X−. The cylinder block 103 is moved back to the state of FIG. 5(*a*) and increases the compression ratio. The rotational range of the cam shafts 109 in the normal direction and in the inverse direction is 5 to 90 degrees as mentioned above.

In the course of increasing the compression ratio to the state of FIG. 5(*a*), the cylinder block 103 receives the downward driving force of the servo motor 112 via the cam shafts 109 and moves down to the lower case 104. In this state, the combustion pressure in the combustion chamber still works in the direction of moving up the cylinder block 103 relative to the lower case 104. With an increase in compression ratio, the cylinder block 103 accordingly moves closer to the lower case 104 against the combustion pressure.

The cylinder block 103 may be slid relative to the lower case 104 in a direction of a bottom dead center. In this case, the rotational range of the cam shafts 109 in the normal direction and in the inverse direction is −5 to −90 degrees (that is, 355 to 270 degrees). When the cylinder block 103 is slid relative to the lower case 104 in the direction of the top dead center, the rotational range of the cam shafts 109 may be 90 to 175 degrees.

The compression ratio varying mechanism of this embodiment enables the cylinder block 103 to be slid relative to the lower case 104 along the axis of the cylinders 102 and thereby varies the compression ratio. According to the computation with regard to an engine of certain dimensions, a slidable amount of several millimeters attains a variable compression range of 9 to 14.5.

Figure 6:
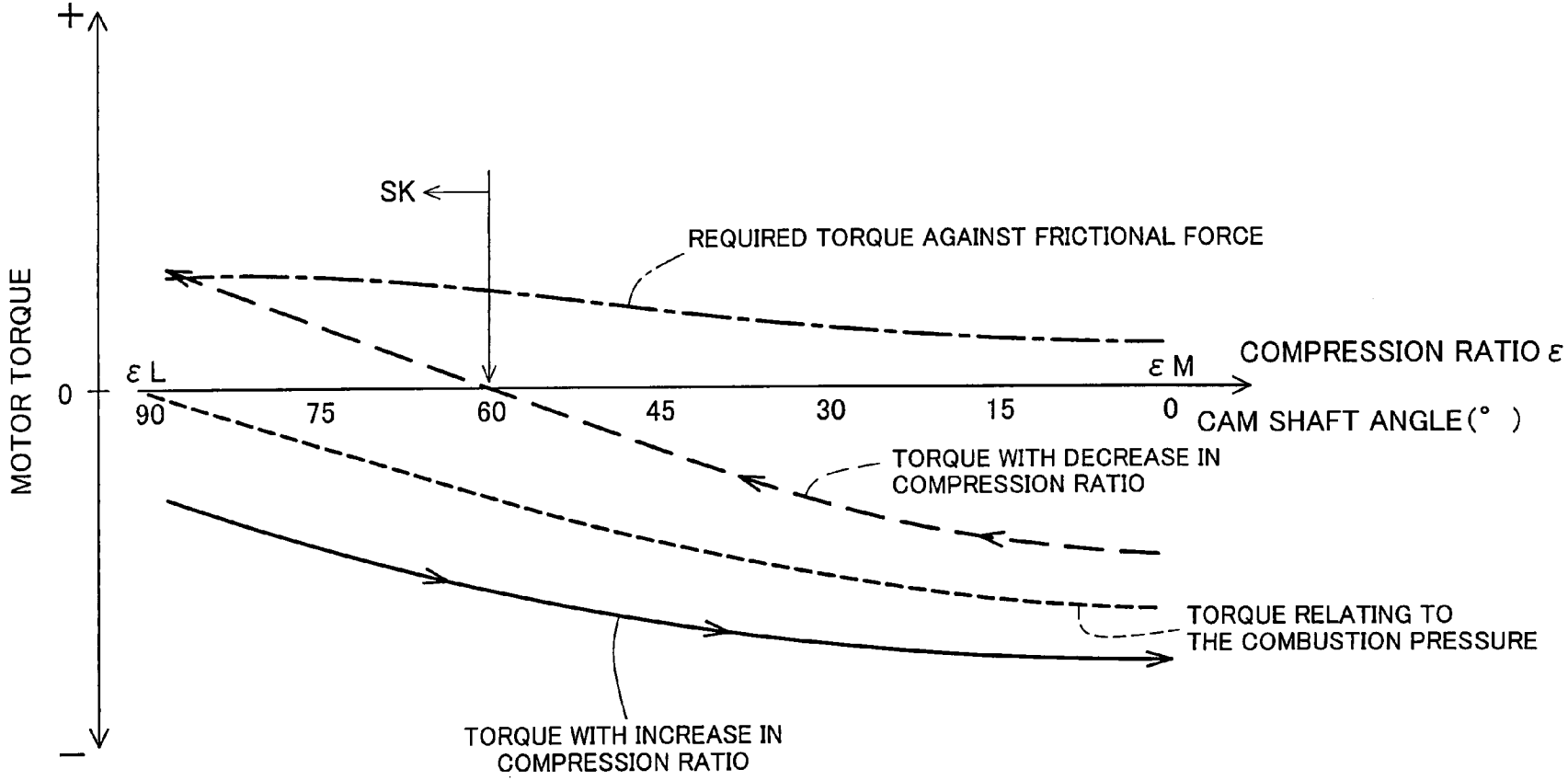
FIG. 6 shows variations of various torques involved in a variation of the compression ratio in a conventional variable compression ratio engine without first spring members 140 and second spring members 150.
Figure 7:
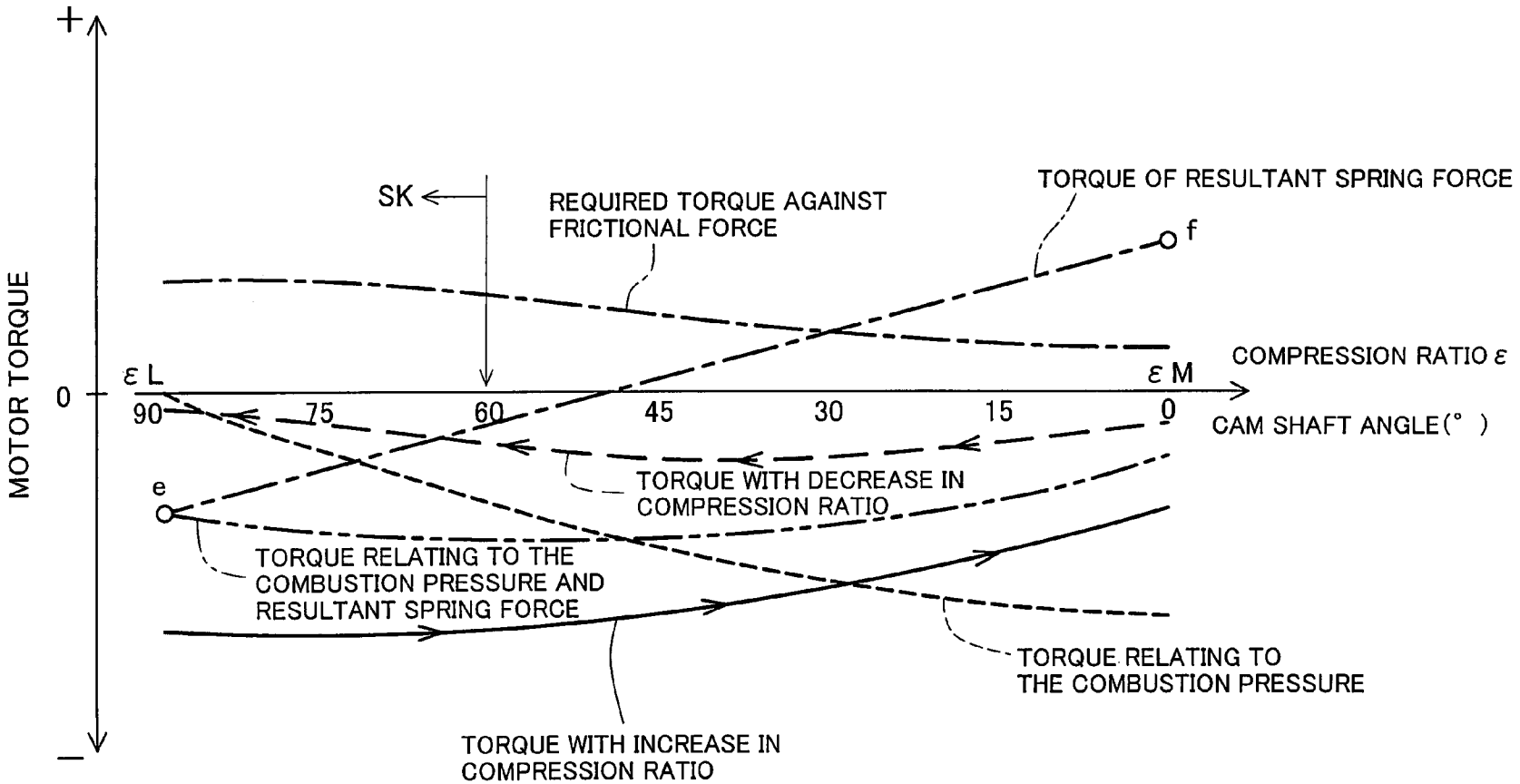
FIG. 7 shows variations of various torques involved in a variation of the compression ratio in the variable compression ratio engine 100 of the first embodiment.

The following describes the forces applied onto the cylinder block 103 and the lower case 104 in the course of a variation in compression ratio in the variable compression ratio engine 100 constructed as discussed above. FIG. 6 shows variations of various torques involved in a variation of the compression ratio in a conventional variable compression ratio engine without the first spring members 140 and the second spring members 150. FIG. 7 shows variations of various torques involved in a variation of the compression ratio in the variable compression ratio engine 100 of this embodiment.

As described above, the respective cam shafts 109 are rotated in the rotational angle range of 0 to 90 degrees to vary the compression ratio between the lower limit compression ratio $\epsilon L$ to the upper limit compression ratio $\epsilon M$. The rotations of the cam shafts 109 and the sliding movement of the cylinder block 103 cause some frictional force. The cylinder block 103 also receives the force of the combustion pressure. The frictional force and the force of the combustion pressure depend upon the rotational angle of the cam shafts 109 (that is, the compression ratio) and affect transmission of the driving torque to the cylinder block 103 via the rotations of the respective cam shafts 109. The frictional force works to interfere with the rotations of the cam shafts 109 and with the sliding movement of the cylinder block 103 relative to the lower block 104, thus preventing transmission of the torque. The servo motor 112 is thus required to have the driving toque against the frictional force. This is shown as a positive torque in FIG. 6. The force of the combustion pressure works in the direction of moving up the cylinder block 103 relative to the lower case 104 and is advantageous for transmission of the driving torque via the rotations of the cam shafts 109 in the course of a decrease in compression ratio. The force of the combustion pressure affecting transmission of the driving torque works in the direction of canceling the frictional force and is shown as a negative torque in FIG. 6.

The discussion first regards the case of decreasing the compression ratio from the upper limit compression ratio $\epsilon M$ to the lower limit compression ratio $\epsilon L$. At the high compression ratio, the torque relating to the combustion pressure exceeds the required torque against the frictional force and works in the same direction as the rotational driving force of the servo motor 112. The rotational driving force of the servo motor 112 with the assistance of the force of the combustion pressure is then transmitted to the cylinder block 103. The assisting torque relating to the combustion pressure thus relieves the load of the servo motor 112.

With a decrease in compression ratio, the force of the combustion pressure decreases. The required torque against the frictional force eventually exceeds the torque relating to the combustion pressure. In a low compression ratio range SK having the cam shaft angle of or over 60 degrees, the force of the combustion pressure does not substantially assist the rotational driving force of the servo motor 112. The servo motor 112 thus has the load in this range SK.

In the case of increasing the compression ratio from the lower limit compression ratio $\epsilon L$ to the upper limit compression ratio $\epsilon M$, on the other hand, the required torque is against both the frictional force and the force of the combustion pressure. The servo motor 112 is thus required to produce a torque corresponding to the sum of the torque relating to the combustion pressure and the required torque against the frictional force.

In the conventional variable compression ratio engine without the first spring members 140 and the second spring members 150, the servo motor 112 is required to attain the torque characteristics shown in FIG. 6 in the case of both the decrease in compression ratio and the increase in compression ratio.

In the variable compression ratio engine 100 of this embodiment, on the other hand, the resultant spring force of the first spring members 140 and the second spring members 150 shown in FIG. 4 is applied to the cylinder block 103 in the case of decreasing the compression ratio from the upper limit compression ratio $\epsilon M$ to the lower limit compression ratio $\epsilon L$. The resultant spring force in the direction of making the cylinder block 103 apart from the lower case 104 functions to assist transmission of the torque in the course of decreasing the compression ratio. The resultant spring force in the direction of making the cylinder block 103 close to the lower case 104, on the other hand, functions to assist transmission of the torque in the course of increasing the compression ratio. The variation in resultant spring force shown in FIG. 4 is added to the graph of FIG. 7. This characteristic curve of resultant spring force varies between the point 'f' at the upper limit compression ratio $\epsilon M$ and the point 'e' at the lower limit compression ratio $\epsilon L$. The graph of FIG. 7 also includes a torque curve of the resultant spring force and the combustion pressure.

The structure of the embodiment has the advantages discussed below, with reference to the comparison between FIGS. 6 and 7.

In the conventional variable compression ratio engine without the first spring members 140 and the second spring members 150, the force of the combustion pressure does not sufficiently assist the transmission of the motor torque in the low compression ratio range SK as shown in FIG. 6. In the variable compression ratio engine 100 of this embodiment, on the other hand, the resultant spring force of the first spring members 140 and the second spring members 150 works in the same direction as the force of the combustion pressure in this low compression ratio range SK. The resultant spring force in combination with the force of the combustion pressure then effectively assists the transmission of the motor torque. This arrangement decreases the required torque in the low compression ratio range SK in the course of decreasing the compression ratio. The torque curve of the combustion pressure and the resultant spring force has the reverse gradient to that of the torque curve of the required torque against the frictional force. Namely the sum of the combustion pressure and the resultant spring force reduces the effects of the frictional force acting to interfere with transmission of the torque.

In the case of decreasing the compression ratio from the upper limit compression ratio $\epsilon M$, the resultant spring force functions to interfere with transmission of the torque, like the frictional force. In the range of high compression ratio with a large resultant spring force, however, the significantly large force of the combustion pressure functions to assist the transmission of torque. There is accordingly no significant increase in torque. The torque of resultant spring force desirably reduces the total torque variation in the course of decreasing the compression ratio from the upper limit compression ratio $\epsilon M$ to the lower limit compression ratio $\epsilon L$ and attains the favorable motor control. The torque curve of the combustion pressure and the resultant spring force has the reverse gradient to that of the torque curve of the required torque against the frictional force. This reduces the total variation of the combustion pressure, the resultant spring force, and the frictional force and thereby the variation in motor torque.

In the course of increasing the compression ratio, the resultant spring force works to interfere with transmission of the torque in the low compression ratio range SK, like the force of the combustion pressure. The greater torque than the torque curve of FIG. 6 is thus required in this low compression ratio range SK. With a further increase in compression ratio, the resultant spring force works in the inverse direction to assist the transmission of the torque. This arrangement desirably prevents a significant torque increase in total, even when the force of the combustion pressure works to interfere with transmission of the torque in the low compression ratio range. This is also explainable by the effects of the combination of the forces.

As described above, the variable compression ratio engine 100 of this embodiment effectively reduces the required driving force of the servo motor 112 in the course of a variation in compression ratio. The servo motor 112 is thus not required to have the significantly high torque characteristics. The rotation of the servo motor 112 is simply inverted with a variation in compression ratio, while no special torque control is required. This arrangement of the embodiment desirably reduces the size of the servo motor and the variable compression ratio engine including the compression ratio varying mechanism and simplifies the control of the servo motor.

In the course of decreasing the compression ratio, the resultant spring force works in the direction of making the cylinder block 103 apart from the lower case 104 and is thus advantageously used to assist the transmission of torque in the low compression ratio range SK.

A decrease in compression ratio requires an increase in load of the engine. A slow variation in compression ratio thus heightens the potential for knocking. Sufficient quickness is thus essential for the decrease of the compression ratio. A further decrease in compression ratio in the low compression ratio range SK requires a further increase in load of the engine, while the high load has already been applied to the engine. In the structure of this embodiment, in the course of a further decrease in compression ratio, the resultant spring force is applied in the direction of making the cylinder block 103 apart from the lower case 104 in this low compression ratio range SK (see FIGS. 4 and 7). This arrangement ensures a quick decrease of the compression ratio and desirably lowers the potential for knocking. This arrangement does not require a significantly high response of the servo motor 112 to attain the quick decrease in compression ratio, thus desirably reducing the required size of the servo motor 112.

Figure 8:
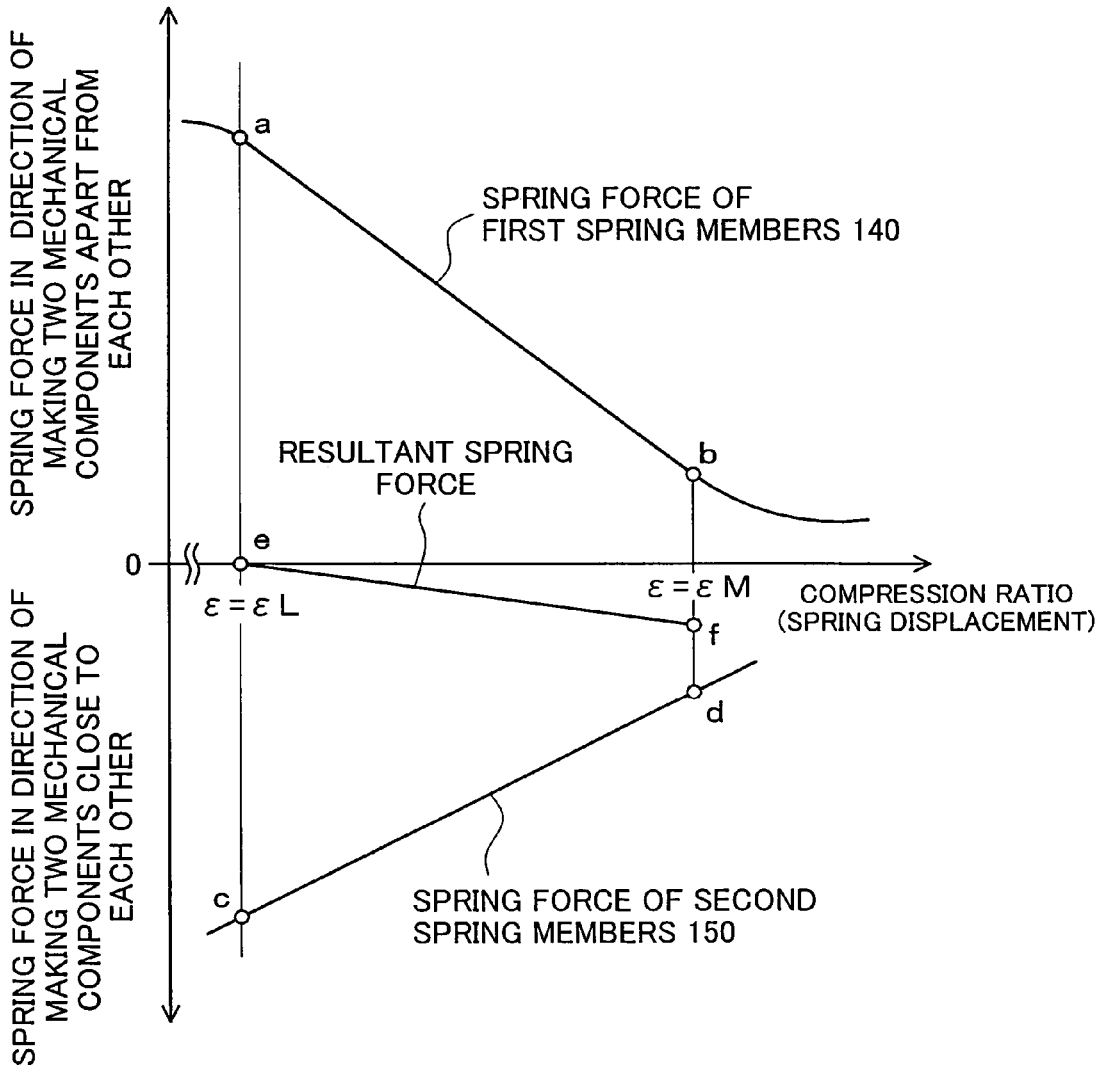
FIG. 8 shows another example of a resultant spring force of the first spring members 140 and the second spring members 150.
Figure 9:
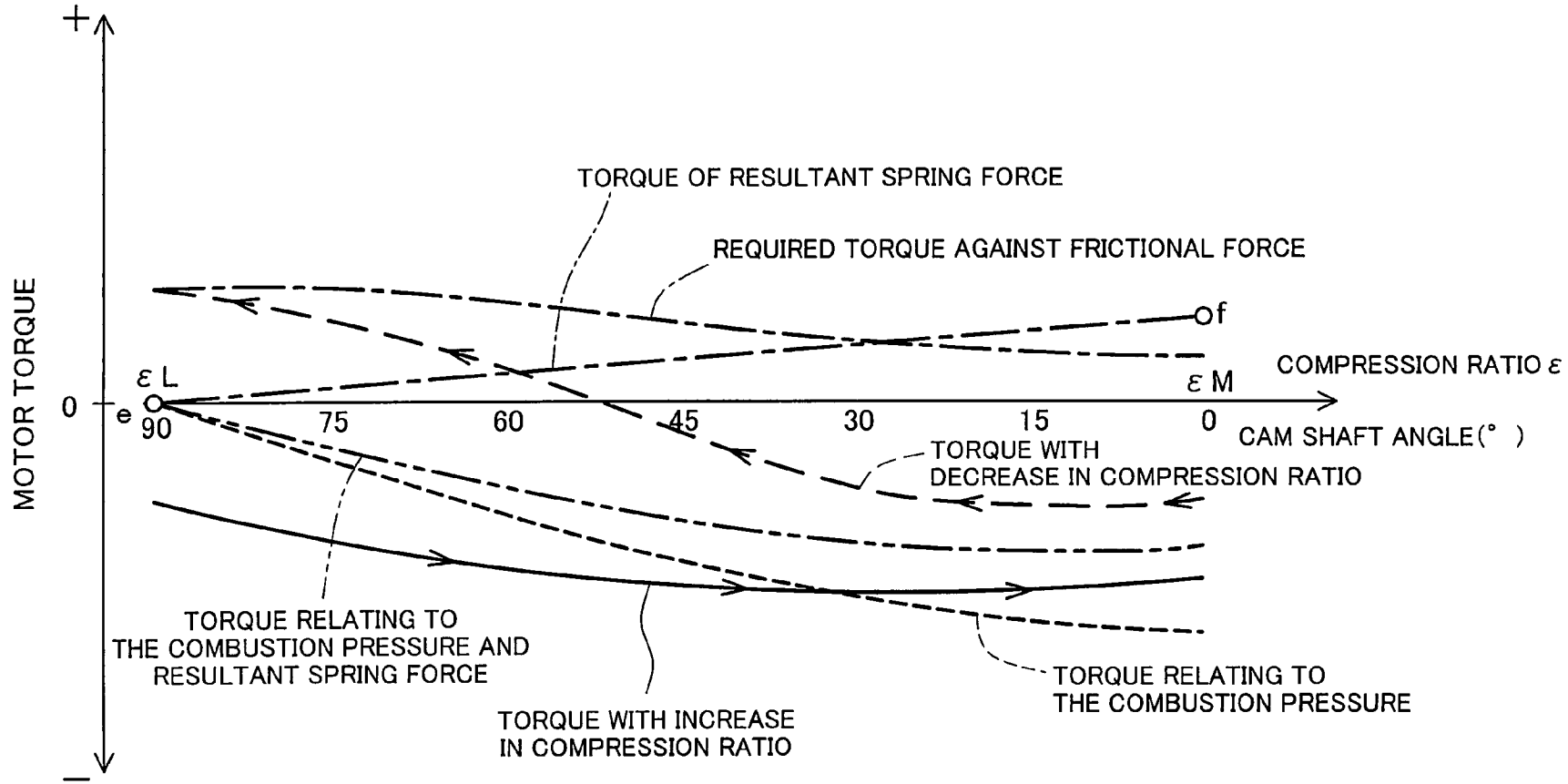
FIG. 9 shows variations of various torques involved in a variation of the compression ratio in the example of the resultant spring force shown in FIG. 8.

The variable compression ratio engine 100 of the embodiment may have any of diverse spring force characteristics. FIG. 8 shows another example of the resultant spring force of the first spring members 140 and the second spring members 150. FIG. 9 shows variations of various torques involved in a variation of the compression ratio in the example of the resultant spring force shown in FIG. 8.

In the example of FIG. 8, the first spring members 140 have the identical spring force characteristics with those of FIG. 4, while the second spring members 150 have a larger spring constant. The second spring members 150 are designed to apply a substantially equivalent spring force to that of the first spring members 140 (point 'c') in the direction of making the two mechanical components close to each other at the lower limit compression ratio $\epsilon L$ and to apply a substantially two-fold spring force as much as that of the first spring members 140 (point 'd') at the upper limit compression ratio $\epsilon M$. The cylinder block 103 and the lower case 104 accordingly receive the resultant spring force of the first spring members 140 and the second spring members 150, which is expressed by a characteristic curve connecting a point 'e' with a point 'f'. The resultant spring force is always acted in the direction of making the cylinder block 103 close to the lower case 104.

In the example of FIG. 9, the resultant spring force is acted to assist transmission of the torque over the whole variable range of the compression ratio. The resultant spring force increases with an increase in compression ratio. The resultant spring force works in the direction of canceling the force of the combustion pressure acting to interfere with the torque transmission. This arrangement decreases the motor torque required over the whole range of compression ratio in the course of increasing the compression ratio and the maximum torque required to attain the upper limit compression ratio $\epsilon M$, thus desirably reducing the required size of the servo motor 112. In this example, the required motor torque increases in the course of decreasing the compression ratio. The required motor torque is, however, not significantly increased, since both the force of the combustion pressure and the resultant spring force are large in the range of high compression ratio.

The spring force characteristics of the first spring members 140 and the second spring members 150 may be changed to always apply the resultant spring force in the direction of making the cylinder block 103 apart from the lower case 104. Such modification effectively reduces the motor torque in the case of decreasing the compression ratio.

Figure 10:
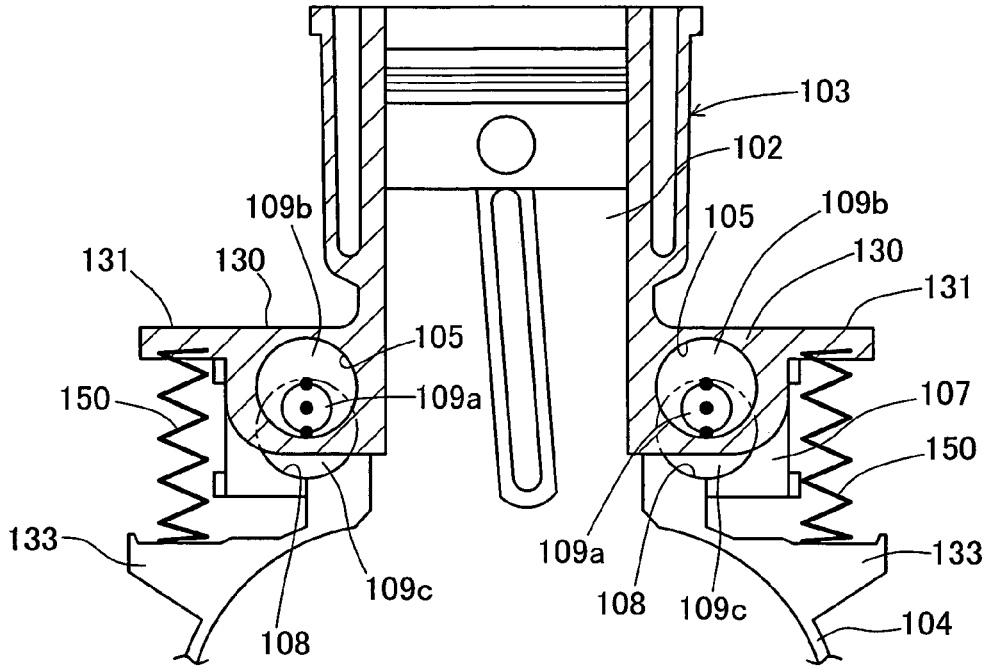
FIG. 10 schematically illustrates the structure of a variable compression ratio engine 200 in a second embodiment of the invention.
Figure 11:
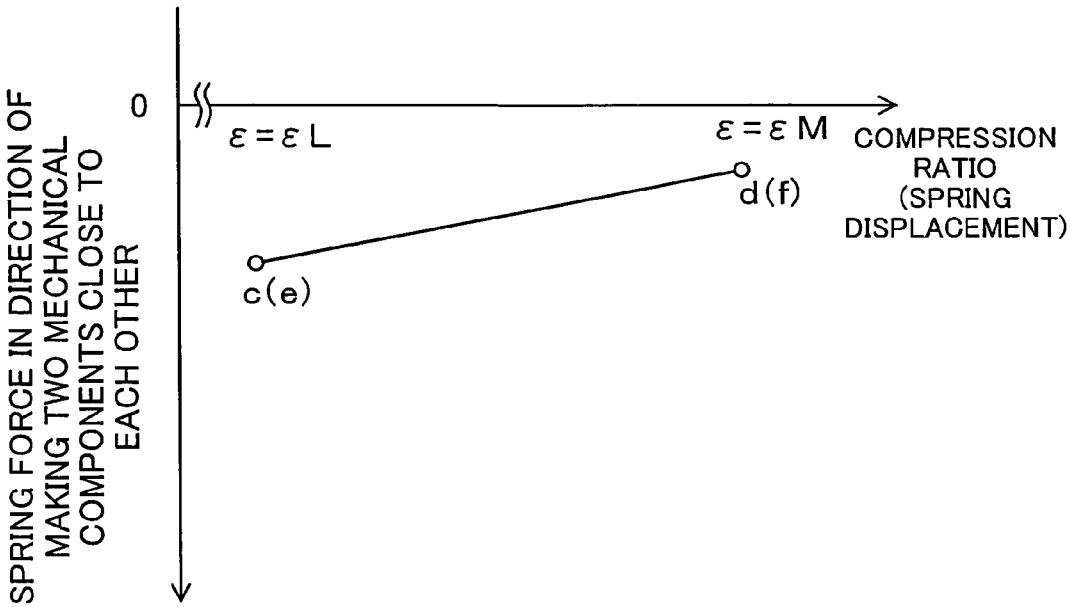
FIG. 11 shows variations of spring forces against a variation in compression ratio in the variable compression ratio engine 200 of the second embodiment.
Figure 12:
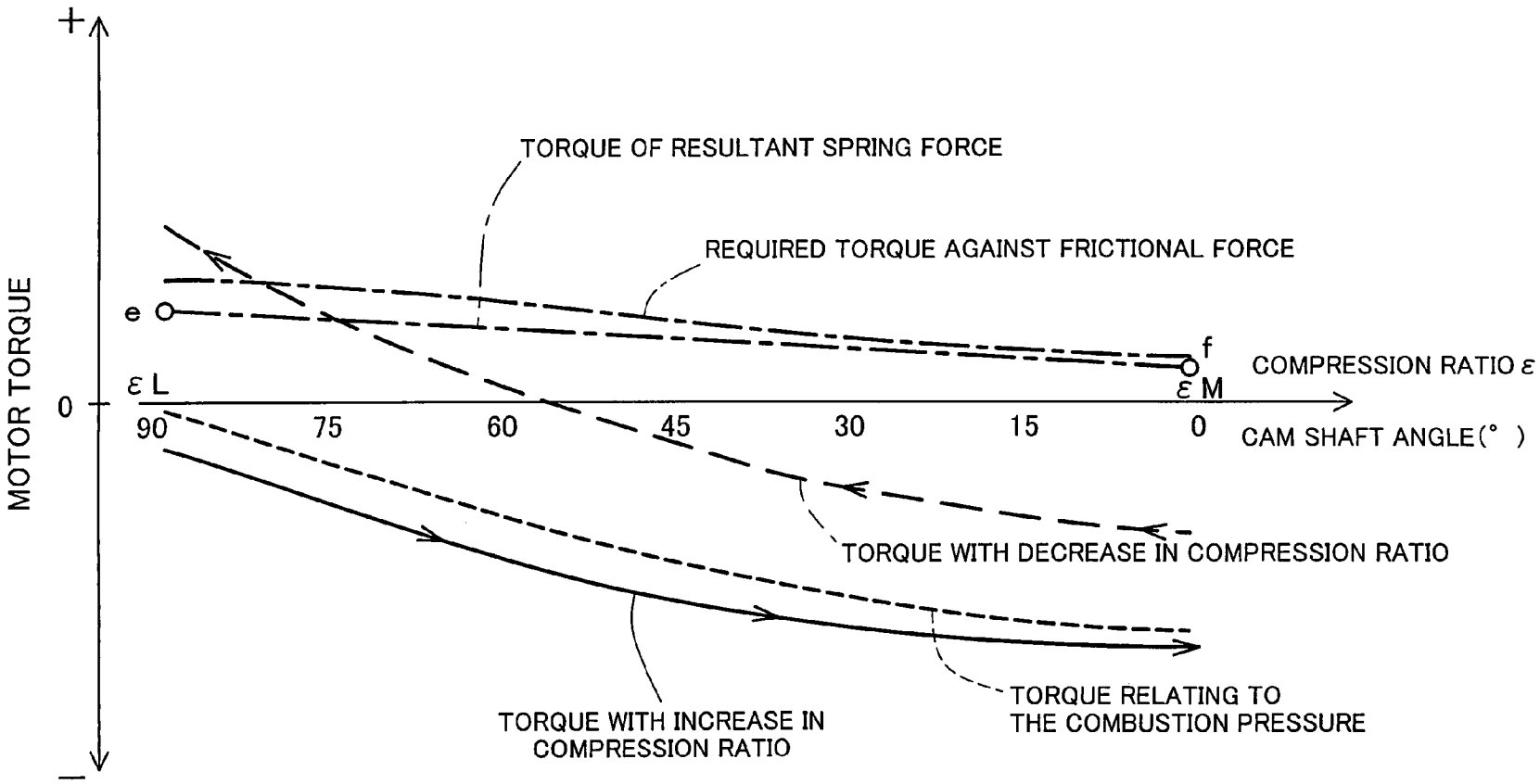
FIG. 12 shows variations of various torques involved in a variation of the compression ratio in the variable compression ratio engine 200 of the second embodiment.

The structure of the first embodiment may be modified in various ways. In the structure of a second embodiment, the rows of the second spring members 150 are arranged on both sides of the cylinder block 103. FIG. 10 schematically illustrates the structure of a variable compression ratio engine 200 in the second embodiment of the invention. FIG. 11 shows variations of spring forces against a variation in compression ratio in the variable compression ratio engine 200 of the second embodiment. FIG. 12 shows variations of various torques involved in a variation of the compression ratio in the variable compression ratio engine 200 of the second embodiment. FIGS. 11 and 12 respectively correspond to FIGS. 8 and 9 in the modified example of the first embodiment.

The rows of the second spring members 150 are arranged on both sides of the cylinder block 103 in the variable compression ratio engine 200 of the second embodiment. In the state of FIG. 10, the respective second spring members 150 are set with a large tensile displacement at the lower limit compression ratio εL. In the illustrated state, the second spring members 150 produce a large spring load (spring force) in a direction of making the cylinder block 103 close to the lower case 104 and apply this large spring force onto the cylinder block 103 and the lower case 104. An increase in compression ratio from this illustrated state decreases the tensile displacement of the second spring member 150 and thereby reduces the spring load of the second spring member 150. The second spring members 150 then reduce the spring force acting in the direction of making the cylinder block 103 close to the lower case 104 and apply the reduced spring force onto the cylinder block 103 and the lower case 104.

In the structure of this embodiment, the spring force of the second spring members 150 is always acted in the direction of making the cylinder block 103 close to the lower case 104.

In the state of FIG. 12, the resultant spring force is always acted to assist transmission of the torque over the whole variable range of the compression ratio and works in the direction of canceling the force of the combustion pressure acting to interfere with the torque transmission. This arrangement decreases the motor torque required over the whole range of compression ratio in the course of increasing the compression ratio and the maximum torque required to attain the upper limit compression ratio εM. The spring force of the second spring members 150 has the greater effects on the torque transmission in the range of low compression ratio. This effectively decreases the motor torque required in the course of increasing the compression ratio from this low compression ratio range and thereby relieves a variation in motor torque with an increase in compression ratio. The servo motor 112 is accordingly not required to have extremely high performance or a large size.

The above embodiments are to be considered in all aspects as illustrative and not restrictive. There may be many modifications, changes, and alterations without departing from the scope or spirit of the main characteristics of the present invention. All changes within the meaning and range of equivalency of the claims are therefore intended to be embraced therein.

In the embodiment discussed above, the cylinder block 103 is slid in the direction of the top dead center relative to the lower case 104 to vary the compression ratio. The rotational angle of the respective cam shafts 109 is varied in the range of 0 to 90 degrees. In one possible modification, the cylinder block 103 may be slid in the direction of the bottom dead center relative to the lower case 104. In this case, the rotational angle of the respective cam shafts 109 is varied in the range of −0 to −90 degrees.

Figure 13:
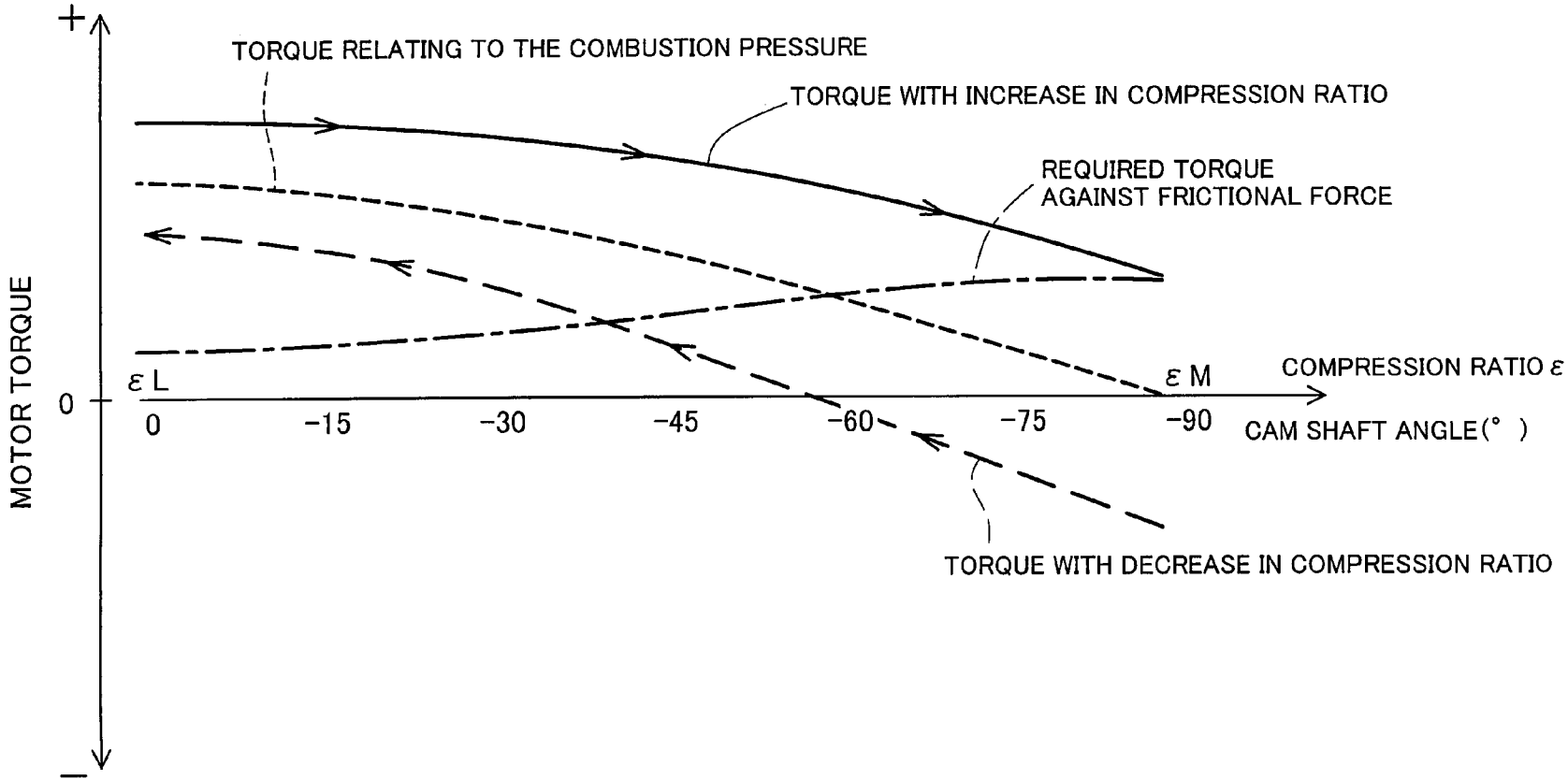
FIG. 13 shows variations of various torques involved in a variation of the compression ratio in the conventional variable compression ratio engine without the first spring members 140 and the second spring members 150 in a modified structure where the cylinder block 103 is slid in the direction of the bottom dead center relative to the lower case.

In this modified structure, the cylinder block 103 and the lower case 104 receive various forces in the course of a variation in compression ratio as described below. FIG. 13 shows variations of various torques involved in a variation of the compression ratio in the conventional variable compression ratio engine without the first spring members 140 and the second spring members 150 in the modified structure where the cylinder block 103 is slid in the direction of the bottom dead center relative to the lower case 104.

In the modified structure to slide the cylinder block 103 in the direction of the bottom dead center for a variation in compression ratio, the centers A, B, and C of the shank 109*a*, the cams 109*b*, and the movable bearings 109*c* are positioned in a mirror image of FIG. 5. The variations of the frictional force and the force of the combustion pressure are accordingly reverse to those of FIG. 6. In the example of FIG. 13, the frictional force interferes with the sliding movement of the cylinder block 103 and thereby with the torque transmission. According to the positional relation of the centers A, B, and C, the required torque against the frictional force is high at the upper limit compression ratio εM and low at the lower limit compression ratio εL. The force of the combustion pressure works in the direction of moving up the cylinder block 103 relative to the lower case 104. In the course of increasing the compression ratio, the force of the combustion pressure advantageously acts on the torque transmission via the cam shafts 109. In the structure to slide the cylinder block 103 in the direction of the bottom dead center, the torque relating to the combustion pressure is accordingly involved in the torque transmission in the same manner as the required torque against the frictional force and is maximized at the lower limit compression ratio εL as shown in FIG. 13.

In the modified structure to slide the cylinder block 103 in the direction of the bottom dead center, the torque against the frictional force and the torque relating to the combustion pressure act in the inverse directions as described above. In this modified structure, the row of the first spring members 140 and the row of the second spring members 150 may be disposed on both sides of the cylinder block 103, like the first embodiment. The spring force characteristics of the first spring members 140 and the second spring members 150 are regulated to make the resultant spring force of the first spring members 140 and the second spring members 150 assist the torque transmission of the driving force of the servo motor 112. This effectively reduces the motor torque and relives the variation in motor torque.

In the embodiments discussed above, the combination of the cams 109*b* with the cylinder block 103 and the combination of the movable bearings 109*c* with the lower case 104 constitute the compression ratio varying mechanism. The compression ratio varying mechanism may alternatively be constructed by the combination of the cams with the lower case and the combination of the movable bearings with the cylinder block. The cams 109*b* preferably have the true circular shape, but may have another suitable shape. For example, in the structures of the above embodiments, the cams may have an oval shape or an elliptical shape having the longitudinal diameter identical with the diameter of the cams 109*b*.

The technique of the invention is also applicable to V-engines and horizontally opposed engines. In these engines, a pair of cam shafts may be disposed for each bank. In the V-engines, a pair of cam shafts may be disposed on the base of two banks. The whole V-bank may be slid to the center of the central angle defined by the two banks to vary the compression ratio.

The scope and spirit of the present invention are indicated by the appended claims, rather than by the foregoing description.

What is claimed is:

1. An internal combustion engine that varies a compression ratio, said internal combustion engine comprising:

a driving source that generates a rotational driving force to vary a compression ratio;

a transmission module that transmits the rotational driving force;

a compression ratio varying mechanism that receives the rotational driving force transmitted by said transmission module, drives at least one of a cylinder block and a crank casing along the axis line of a cylinder with the received rotational driving force, so as to vary a volume of a combustion chamber, thereby varying the compression ratio; and a pressing module that produces a pressing force, which is to be applied to said cylinder block and said crank casing, in the course of actuation of said compression ratio varying mechanism to vary the compression ratio, said pressing module producing the pressing force according to the driving state of said cylinder block and said crank casing and applying the pressing force to said cylinder block and said crank casing to reduce a transmission torque of the rotational driving force of said driving source by said transmission module, thereby assisting said compression ratio varying mechanism to vary the compression ratio, wherein said compression ratio varying mechanism drives at least one of said cylinder block and said crank casing, so that the relative position of them changes along the axis line of the cylinder of the combustion chamber, wherein the pressing force is applied along the moving direction of said cylinder block and said crank casing, the pressing force is applied along the moving direction of said cylinder block and said crank casing, and said pressing module applies the pressing force to said cylinder block and said crank casing, such that the pressing force is combined with a first force, which is produced by a combustion pressure to be involved in the transmission of the rotational driving force to said compression ratio varying mechanism by said transmission module, and with a second force, which is produced by actuation of said compression ratio varying mechanism to be involved in the transmission of the rotational driving force, to reduce the transmission torque.

2. An internal combustion engine in accordance with claim 1, wherein said pressing module comprises a spring mechanism that has a spring characteristic regulated to supplement the first force in an actuation state of said compression ratio varying mechanism to decrease the compression ratio.

3. An internal combustion engine in accordance with claim 1, wherein said pressing module comprises a spring mechanism that has a spring characteristic regulated to relieve the first force in an actuation state of said compression ratio varying mechanism to increase the compression ratio.

* * * * *